US006253583B1

(12) United States Patent
Brandl et al.

(10) Patent No.: US 6,253,583 B1
(45) Date of Patent: Jul. 3, 2001

(54) WARP KNITTING MACHINE WITH PATTERN

(75) Inventors: Klaus Brandl, Hainburg; Kresimir Mista, Heusenstamm, both of (DE)

(73) Assignee: Karl Mayer Textilmachinenfabrik GmbH, Obertshausen (DE)

( * ) Notice: Subject to any disclaimer, the term of this patent is extended or adjusted under 35 U.S.C. 154(b) by 0 days.

(21) Appl. No.: 09/670,294

(22) Filed: Sep. 26, 2000

(30) Foreign Application Priority Data

Sep. 30, 1999 (DE) ..... 199 46 859

(51) Int. Cl.[7] ..... D04B 23/00
(52) U.S. Cl. ..... 66/206; 66/204; 66/205
(58) Field of Search ..... 66/82 R, 84 R, 66/203, 204, 205, 206

(56) References Cited

U.S. PATENT DOCUMENTS 2,266,112 * 12/1941 Wirth ..... 66/206
2,687,027 * 8/1954 Merkel ..... 66/206
3,466,898 * 9/1969 Kohl ..... 66/206
5,533,366 * 7/1996 Mista et al. ..... 66/205

FOREIGN PATENT DOCUMENTS

4418714 * 6/1995 (DE) ..... 66/205

* cited by examiner

*Primary Examiner*—Danny Worrell
(74) *Attorney, Agent, or Firm*—Omri N. Behr

(57) ABSTRACT

A warp knitting machine with bearded needles (5) and a pattern press comprises a driven press bar (10) having individual press elements thereon. These are so controllable that during the working stroke (47) of the press bar (10) at choice there is provided a press contact onto the hooks (19) of the corresponding bearded needles (5) or not. Every pressing element (46) is provided with a piezoelectric bending transducer ((42) attached at one end whose free end (45) in the direction of the needle bed may either move from a first position during the working stroke 47 into a press contact and in a second position in which the press element 46 or a power transmitting element located forwardly thereof in the direction of the needle bed may be displaced. In this manner, it is possible to provide a safely constructed pattern press suited for high velocity operation.

18 Claims, 5 Drawing Sheets

WARP KNITTING MACHINE WITH PATTERN

FIELD OF THE INVENTION

The invention is directed to a warp knitting machine with bearded needles and a pattern press comprising a driven press bar and individually steerable press elements thereon which, as desired during the working stroke of the press bar may either exercises press contact with the hooks of the appropriate bearded needles or not.

In the known warp knitting machines of this type (DE-PS 445 428) the press contact is achieved therein that a press bar carried by a lever is moved towards the bearded needles wherein a pin shaped press element carried by the press bar acts upon the hooks of the bearded needles. With the assistance of harness cords the pressing elements parallel to the needle shafts can be lifted so far that the bearded needles can freely move away.

In DE 44 18 714 (U.S. Pat. No. 5,533,366) there is provided a warp knitting machine having guide bars wherein the guides are provided with the free ends of a plurality of piezoelectric bending transducers, wherein one end of the bending transducers is affixed to the guide bar. By electrical control of the bending transducers, the guides are caused to take one of two positions determined by stops. This allows the patterning of the goods.

The task of the invention is to improve the patterning press of a warp knitting machine of the prior art.

The invention solves this problem wherein each pressing element is provided to a piezoelectric bending transducer attached to one end thereof, the free end of said transducers, in the direction of the needle bed is displaceable from a first position during the working stroke so that press contact occurs, and in a second position in the pressing element or a force transmitting element provided in series therewith in the direction of the needle bed, is deviated.

In the first position the working stroke of the pressing element is carried over to the hooks of the bearded needles, in the second position on the other hand because of the displacement, the press element for example, a force transmitting element in series therewith to and after provided force transmitting element moves sidewardly past the bearded needle. The return path of the free end of the bending transducer is exceedingly short. This allows for a high working speed since a piezoelectric bending transducer follows steering commands exceedingly rapidly. The complexity of construction is low. Bending transducers can be provided next to each other with very small separation so that it is possible to provide each bearded needles with its own bending transducer.

A particularly simple construction results from the piezoelectric bending transducers being attached to the press bar and carrying the pressing element at their free end.

A preferred alternate embodiment exists therein that the piezoelectric bending transducer is affixed to the press bar and its free end is coupled with a pressing element in the form of a lever wherein, the lever is carried by the press bar. By use of the lever the bending transducer is not subjected to the pressing force. Thus, it may be constructed in a weaker and thus narrower manner.

It is also desirable that the press element is in the form of a guided slider. The piezoelectric bending transducer is attached to the press bar and the free end thereof in the first position interacts with the slider and in the second position is displaced relative to the slider. The use of such slider permits the hooks of the bearded needles to be contacted very accurately.

In a similarly desirable alternative it is provided that the press element as a guided slider, the piezoelectric bending transducer is attached to a carrier affixed to the machine and its free end is provided with a protrusion which grips into a longitudinal groove of a lever born by the press bar and this, in the first position, interacts with the slider and in the second position is displaced with respect to the slider. Also in this modification the bending transducers are not subjected to the force of the pressing force. Since they are attached to a carrier rigidly attached to the machine, the electrical conduit lines do not create any problems. Since they are attached to a carrier attached to the machine, the electrical conduit lines do not exercise any bias during the working stroke. Preferably the pressing element is a sliding element guided in a longitudinal slot. These slots allow very accurate interaction with the bearded needles.

It is an equally desirable alternative to provide that the slider is swingable about an axis parallel about the needle bed.

It is also useful to provide the sliders with return stop onto which cams attached to the press bar can grip. These unidirectional acting return stops serve their function without influencing the switching action of the bending transducer.

It is also advantageous that the slider is covered with a friction resistant sliding coating. This supports the rapid to and fro movement of the slider.

It is advantageous to provide that the guides for several sliders are collected together in a single guide segment. Thus, repairs can be readily carried out by removal and replacement of such segments.

It is also desirable to provide a plurality of parallel piezoelectric bending transducers in a transducer segment which carries stops determining the first and second position of the free ends. These stops enable exceedingly accurate positioning.

It is further desirable that the pressing elements and/or the bending transducers are provided with polymeric caps. This reduces noise and abrasion.

It is further desirable to provide these polymeric caps with a side wall protruding beyond the front face. This side wall serves as a secure separation between neighboring pressing elements.

The invention will be further described with respect to the preferred embodiments as set forth in the drawings.

DESCRIPTION OF THE PREFERRED EMBODIMENTS

Figure 1:
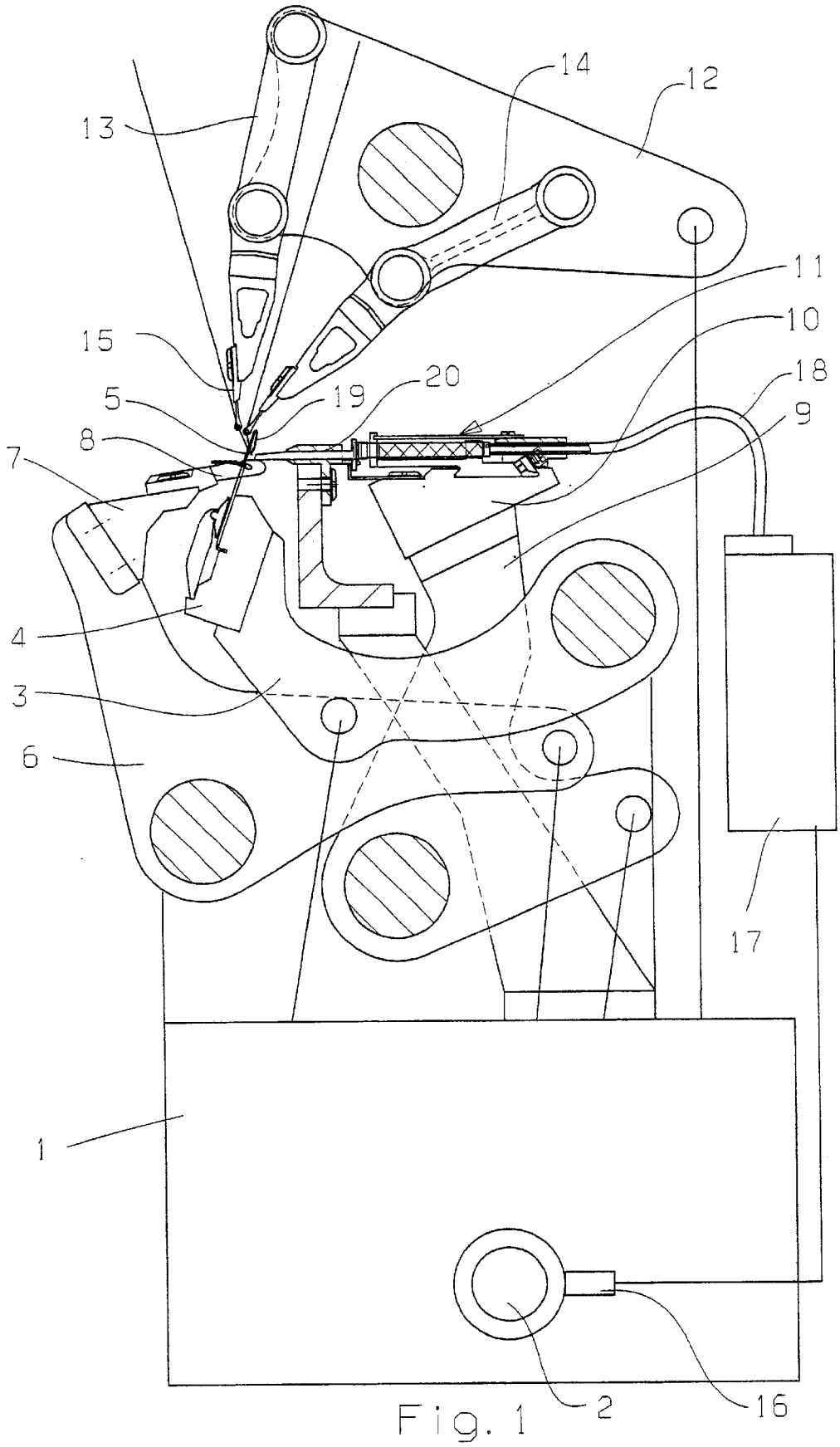
FIG. 1 is a schematic representation of a warp knitting machine in accordance with the present invention.

The warp knitting machine in accordance with FIG. 1 comprises a machine frame 1 and a main shaft 2 which drives a needle bed 4 with bearded needles 2 via a lever 3, a sinker bar 7 with closing knockover sinkers 8 via lever 6, a press bar 10 with a piezoelectric bending transducer control arrangement 11 via lever 9, and guide bars 13 and 14 with guides 15 via level 12. A sensor 16 generates a rotational angle signal corresponding to the rotational angle which is led to the pattern provider 17. This provides signals the control instructions corresponding to the desired pattern via conduit 18 to the bending transducers control arrangement 11. In consequence thereof a selection of press elements 20 are pressed against the hooks 12 of needles 5, as will be described in detail hereinbelow.

Figure 2:
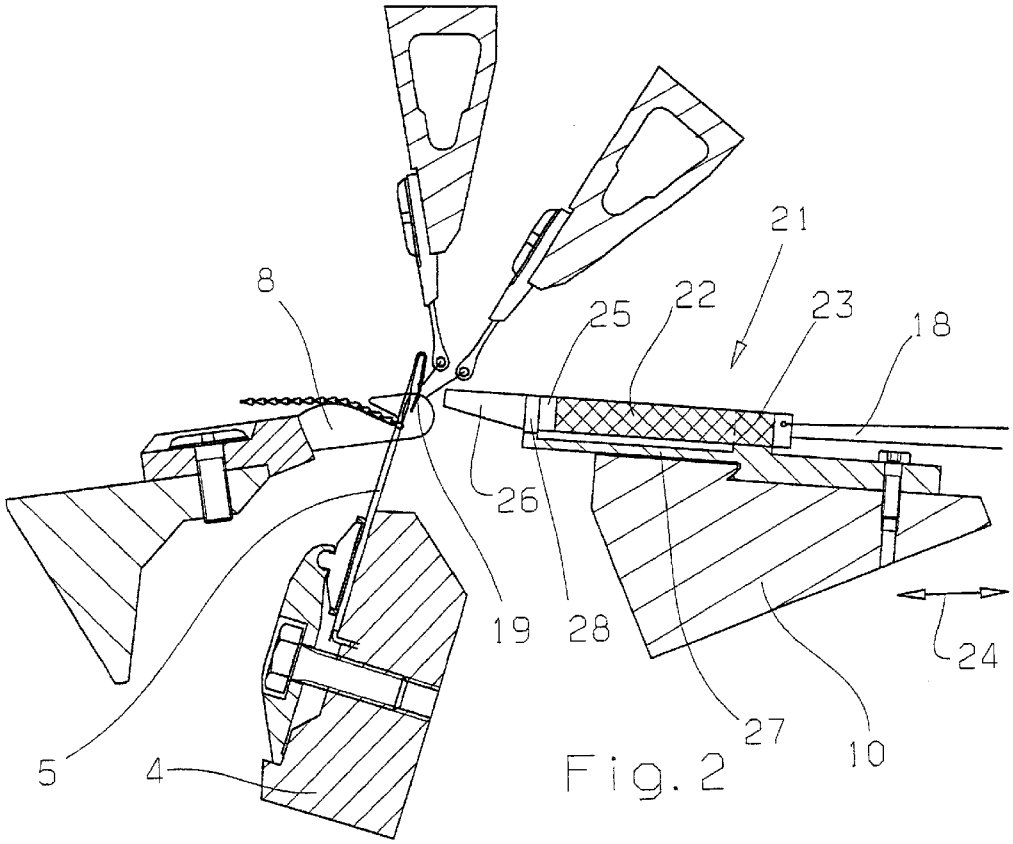
FIG. 2 is A—A a cross-sectional view of the working area of a first embodiment of a pattern press in accordance with the present invention.

In the bending transducer arrangement 21 as shown in FIG. 2, strip formed piezoelectric bending transducers 22 are affixed at one end 23 and connected with press bar 10 which moves in the direction of working stroke 24. The free end 25 of bending transducer 22 is rigidly connected with a press element 26. When the press element 26 find itself in the first position during the working stroke 24, it impinges upon hook 19 of needle 5 and closes the hook space so that subsequent thereto, with the assistance of sinker 8, a stitch is knocked over. When free end 25 is moved slightly into the direction of the needle bed, that is to say, perpendicular to the plane of the drawing, the press element 26 moves between neighboring needles 5 without touching these. The transducers 22 are affixed together into segments 27 which also carry stops 28, which clearly define the first and the second positions of free end 25.

Figure 3:
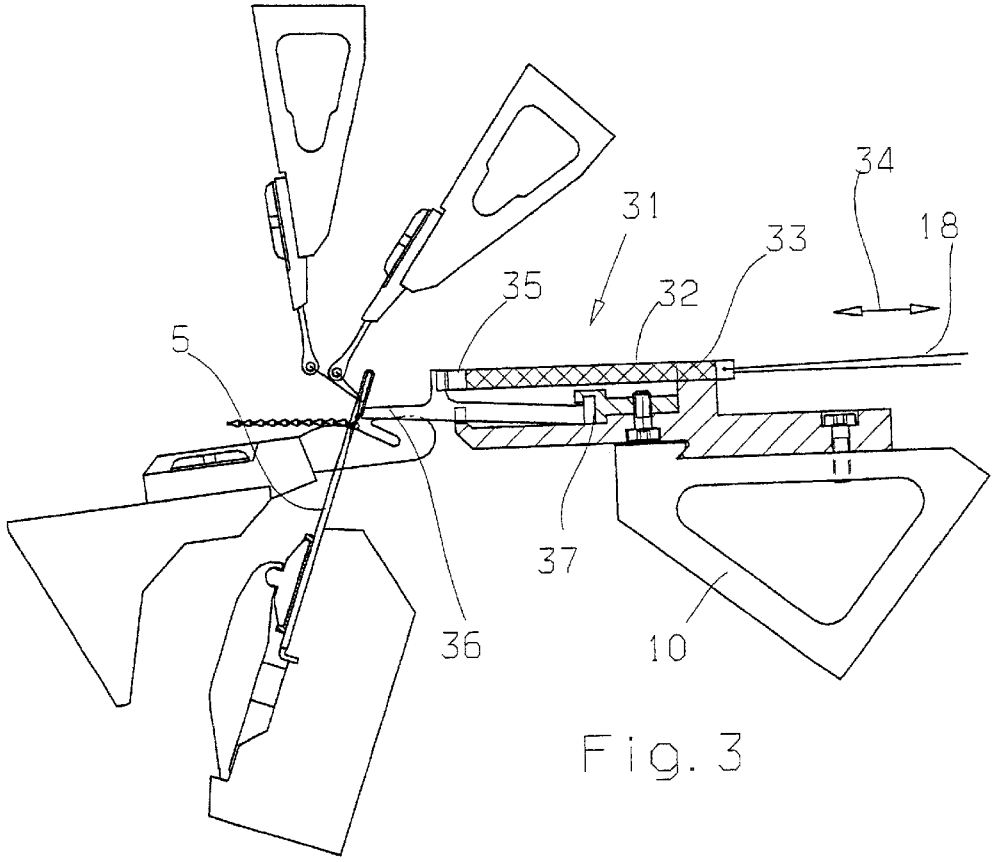
FIG. 3 is A—A of a second embodiment.

In the embodiment shown in FIG. 3 the transducer control arrangement 31 comprises a transducer 32 which again is affixed at end 33 and connected with a press bar 10. The free end 35 of the deflector 32 is connected with a press element 36 in the form of a lever. This lever, via bearing 37, which is displaced towards spring end 33 is carried by press bar 10. In this arrangement, transducers 32 do not transfer any pressure forces during the working stroke 34. Furthermore, the path of the free end 35 is increased by the left translation at the free end. Thus, one merely requires smaller and weaker deflectors 32. Also here, in the first position of the transducer 32, press element 36 presses on the hook of needle 5, whereas press element 36 in the second position of the free end of the transducer 32 moves past the needle 5.

Figure 4:
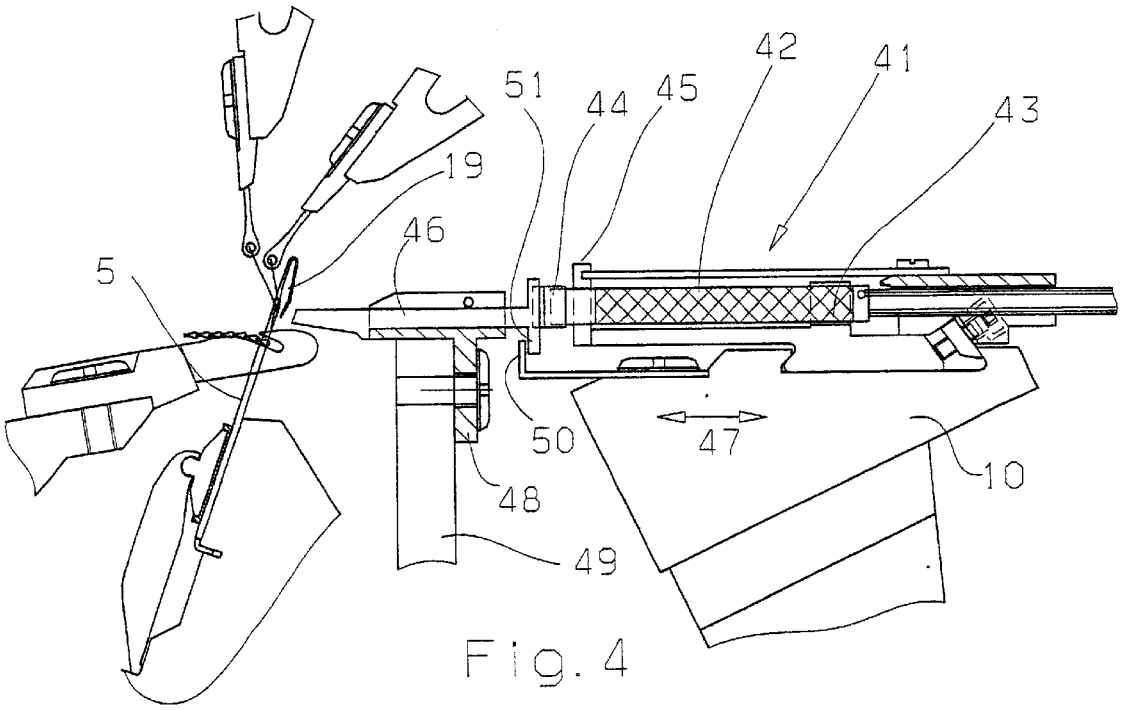
FIG. 4 is A—A of a third embodiment.

In the embodiment shown in FIG. 4 the piezoelectric transducer control arrangement 51 comprises a transducer 42 which, at its end 43 is rigidly attached to press bar 10. Thus, the free end 44 can take up two positions which are determined by the stops 45. In the first position a press element 46 in the form of a slider element is pushed against the hook 19 of needle 5. In the second position the free end 44 slips sideways past the press element 46 when the press bar 10 performs the working stroke 47. The press elements 46 are located in longitudinal slots of a guide segment 48 which is held in a carrier 49 rigidly attached to the machine. On the press bar 10 there is provided a cam 50 constructed as a ledge which operates with a return stop 51 on each slider 46 in order to bring this back on the starting position on the backward stroke.

Figure 5:
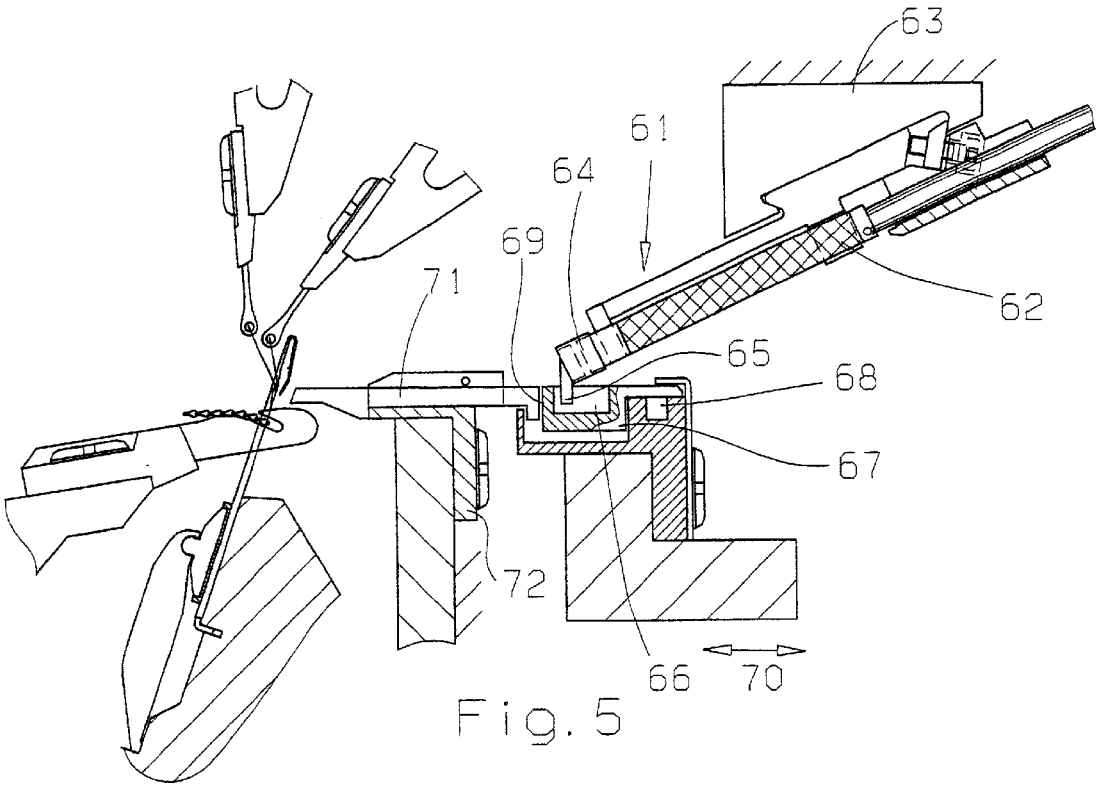
FIG. 5 is A—A of a fourth embodiment.

In the embodiment of FIG. 5 the bending transducer control arrangement 61 at its end 62 is clamped to a carrier 63 rigidly attached to the machine. The protrusion 65 at free end 64 grabs into a longitudinal slot 66 of a lever 67 which is rotatable about a pivot 68. In the first position of the free end 64 of the 62, during the working stroke 70 the left face 69 of lever 67, meets the pressing element 71, constructed as a slider, that is again led into the guide slot of guide element 72. On the other hand, in the second position the lever 66 bypasses the press element 71.

Figure 6:
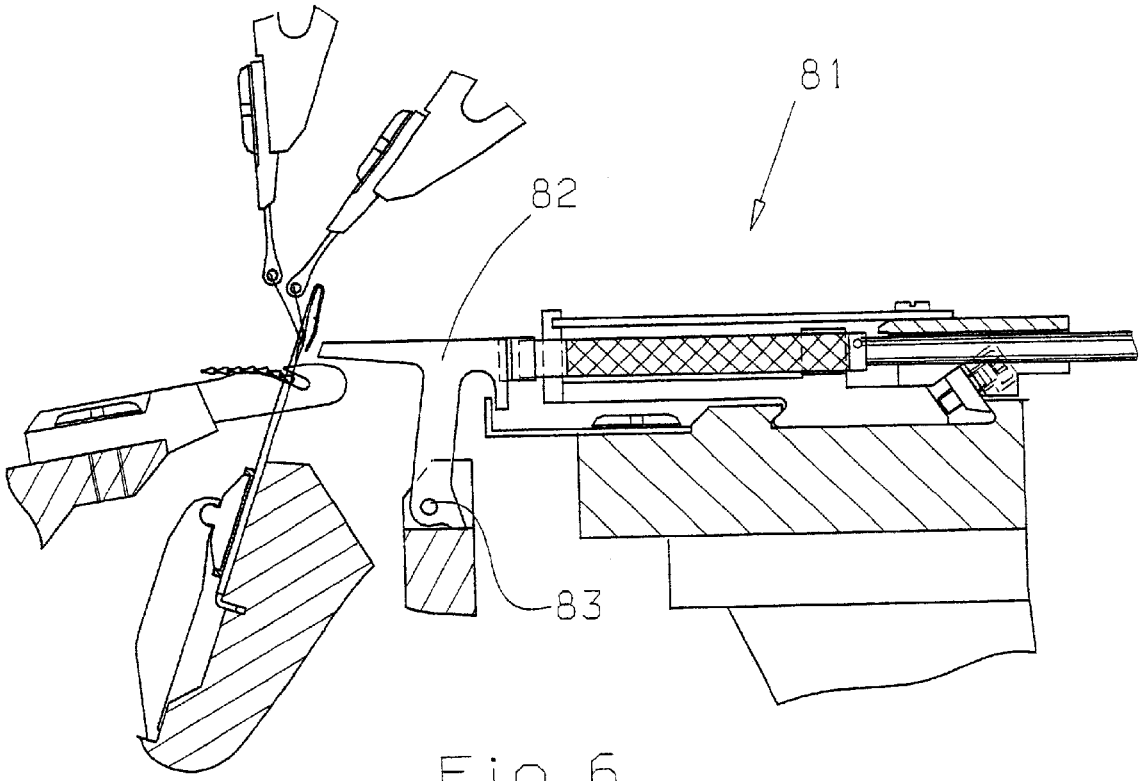
FIG. 6 is A—A of a fifth embodiment.

Transducer control arrangement 81 of FIG. 6 is different from that of FIG. 2 in that a lever is utilized as press element 82 which is swingable about an axis 83 affixed in the machine which runs parallel to the needle bed, that is to say, perpendicular to the plane of the drawing.

Figure 7:
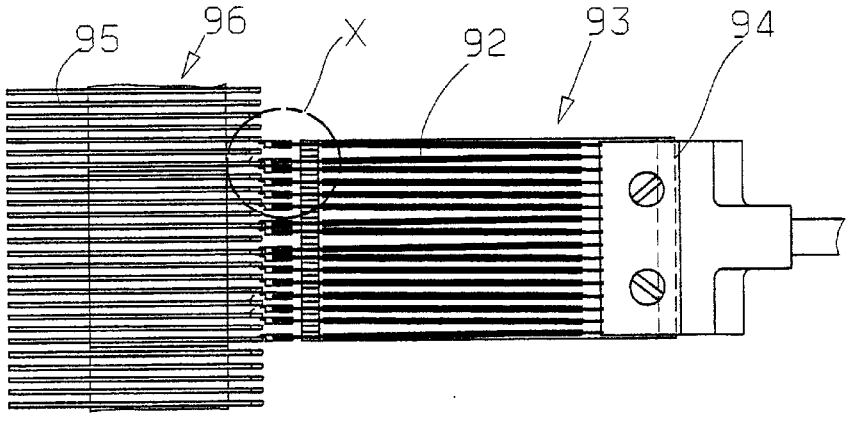
FIG. 7 is a downward plan view on guide segments and a transducer segment.
Figure 8:
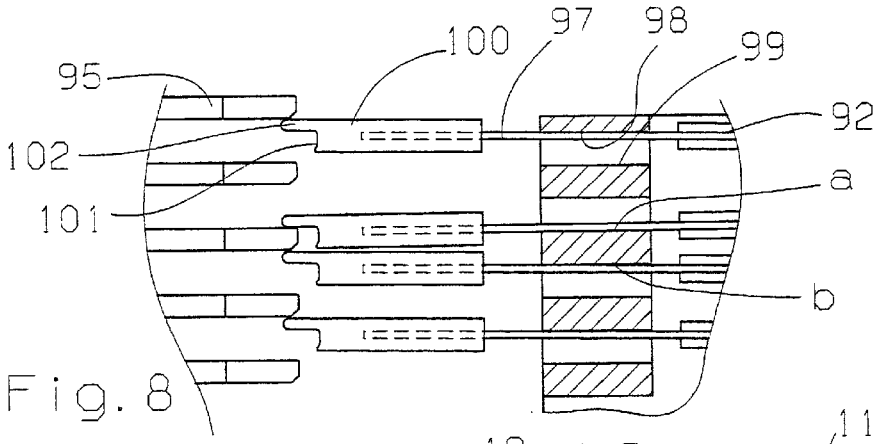
FIG. 8 is an expanded view of area X of FIG. 7.

FIGS. 7 and 8 show an arrangement similar to FIG. 4. A plurality of piezoelectric bending transducers 92 are collected and held together in a bending transducer element 93 which may be taken from and affixed to press bar 1 as a complete unit. For a plurality of press elements 95 there are always provided guide segments 96 which similarly are provided as a single unit.

As is shown in FIG. 8, the free ends 97 of the bending transducer 92 can move between two stops 98 and 99, so that they will take either position "a" or position "b". Each bending transducer 92 is provided with a polymeric cap 100, which comprises a side wall 102 protruding beyond front face 101. This side wall 102 in position a enables a press element 95 to move with it. The side wall 102 ensures that there is always sufficient separation between neighboring press elements.

Figure 9:
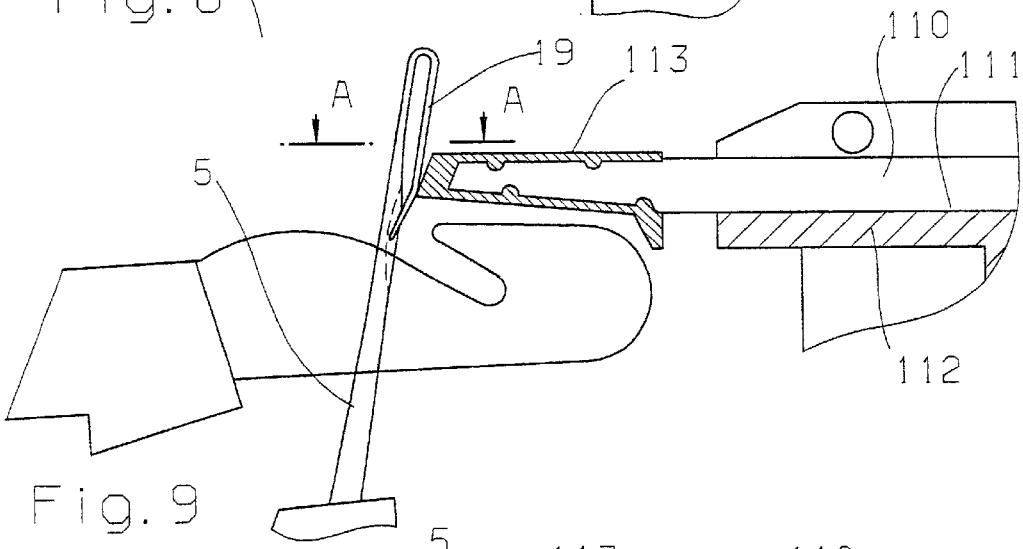
FIG. 9 is an expanded view of the working area of a bearded needle.
Figure 10:
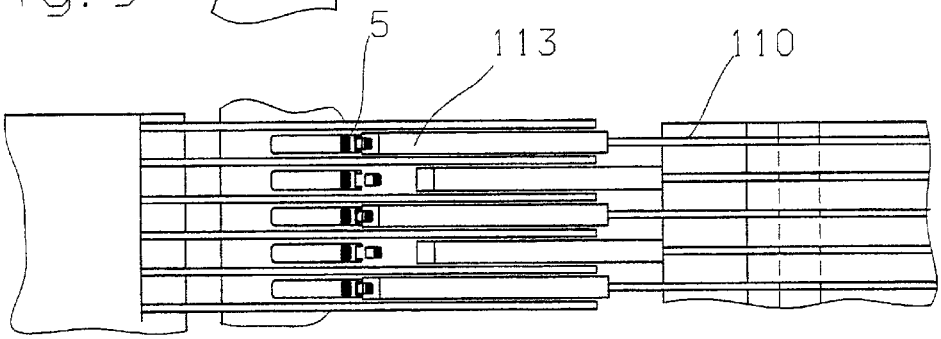
FIG. 10 is a downward plan view of FIG. 9 corresponding to line A—A.

FIGS. 9 and 10 again show the working area of bearded needle 5. Press element 110 is constructed as a sliding element which is led in slot 110 of guide segment 112. This guide segment is affixed to an item rigidly affixed to the machine. The press element 110 has a polymeric cap 113 at its forward end, which protects the needle material and also reduces machine noise. FIG. 10 shows the first, third and fifth press elements 110 having reached the press point and performing the pressing contact. On the other hand, the second and fourth press elements 110 remain in their at rest position and do not perform a pressing contact.

FIGS. 4 to 6 show that the construction parts necessary for the guidance of slider pieces in particular, carrier 49, may be readily located between needle bar 4 and press bar 10.

In the embodiments of FIGS. 2 and 3 the press elements are minimally displaced to the sides so that they move past the bearded needle 5.

On the other hand, in the embodiments of FIGS. 4 through 6 there a force transfer change results between the press bar and the press elements comprising a plurality of force transmission elements. Under these circumstances the pressing element is not displaced sidewards, but by means of one of the previously mentioned force transfer elements for example, bending transducers 42 or lever 67, are prevented from press contact position, in which said free end is positioned so as not to contact said corresponding one of said pressing elements.

What is claimed is:

1. A warp knitting machine, comprising a plurality of bearded needles, each having a hook; a pattern press, including a driven press bar and a plurality of individually and selectively controllable pressing elements on said press bar, each pressing element being aligned with a corresponding one of said needles for contacting said hook thereof; and a plurality of piezoelectric bending transducers, each of which has a fixed end distal to a corresponding one of said pressing elements and a free end proximate to said corresponding one of said pressing elements, said free end being extendable in a generally longitudinal direction toward said corresponding one of said pressing elements and being displaceable in a direction generally transverse to said longitudinal direction between a first position, in which said free end is positioned so as to contact said corresponding one of said pressing elements in response to the extension of said free end in said longitudinal direction, and a second in response to the extension of said free end in said longitudinal direction.

2. A warp knitting machine according to claim 1, wherein the said free end directly contacts said corresponding one of said pressing elements.

3. A warp knitting machine according to claim 1, wherein the said free end indirectly contacts said corresponding one of said pressing elements.

4. A wrap knitting machine according to claim 1, wherein said transducers are attached to said press bar, said free end of at least one of said transducers being rigidly mounted to a corresponding one of said pressing elements.

5. A warp knitting machine according to claim 1, wherein said transducers are attached to said press bar, said free end of at least one of said transducers being coupled to a corresponding one of said pressing elements, said corresponding one of said pressing elements including a lever supported by said press bar.

6. A warp knitting machine according to claim 1, wherein said transducers are attached to said press bar, said free end of at least one of said transducers being engageable with a corresponding one of said pressing elements when said free end is in its said first position, said corresponding one of said pressing elements including a guided slider.

7. A warp knitting machine according to claim 6, wherein said slider is mounted for reciprocating movement in a longitudinal slot.

8. A warp knitting machine according to claim 6, wherein said needles are mounted in a needle bed and said slider is rotatable about an axis parallel to said needle bed.

9. A warp knitting machine according to claim 8, wherein said slider includes stops which interact with cams attached to said press bar.

10. A warp knitting machine according to claim 6, wherein said slider is provided with an anti-friction coating.

11. A warp knitting machine according to claim 6, wherein said slider is moveable along one of a plurality of guide paths in a guided segment.

12. A warp knitting machine according to claim 1, wherein at least one of said transducers is attached to a rigidly mounted carrier, said free end of said at least one of said transducers being provided with a protrusion which is received in a longitudinal slot of a lever carried by said press bar, said lever being engageable with a corresponding one of said pressing elements when said free end is in its said first position, said corresponding one of said pressing elements including a guided slider engageable by said lever when said free end is in its said first position.

13. A warp knitting machine according to claim 12, wherein a said slider is mounted for reciprocating movement in a longitudinal slot.

14. A warp knitting machine according to claim 12, wherein said slider is provided with an anti-friction coating.

15. A warp knitting machine according to claim 1, wherein said transducers are located in a single transducer segment which includes a first stop for delimiting said first position of said free end of a corresponding one of said transducers and a second stop for delimiting said second position of said free end of a corresponding one of said transducers.

16. A warp knitting machine according to claim 1, wherein said free ends of said transducers are provided with polymeric caps.

17. A warp knitting machine according to claim 16, wherein each of said caps is provided with a front face and a side wall which protrudes beyond said front face thereof.

18. A warp knitting machine according to claim 17, wherein said pressing elements are provided with polymeric caps.

* * * * *